US008246161B2

(12) United States Patent
Sootome

(10) Patent No.: US 8,246,161 B2
(45) Date of Patent: Aug. 21, 2012

(54) CONVEYING APPARATUS AND RECORDING APPARATUS

(75) Inventor: Sumitoshi Sootome, Yachiyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/622,144

(22) Filed: Nov. 19, 2009

(65) Prior Publication Data

US 2010/0128097 A1 May 27, 2010

(30) Foreign Application Priority Data

Nov. 21, 2008 (JP) ..... 2008-297966

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 6,536,895 B2 * 3/2003 Kashiwagi et al. ..... 347/104
6,789,888 B2 * 9/2004 Kiyama ..... 347/104
2005/0270355 A1 * 12/2005 Sootome et al. ..... 347/104

FOREIGN PATENT DOCUMENTS

JP 2002-284383 A 10/2002

* cited by examiner

*Primary Examiner* — Omar Rojas
(74) *Attorney, Agent, or Firm* — Canon USA, Inc., IP Division

(57) ABSTRACT

A conveying apparatus includes a conveyance carrier configured to attract and convey a recording medium, a voltage applying unit configured to apply a voltage to the conveyance carrier to generate electrostatic attraction force on a surface of the conveyance carrier, a static charge eliminating unit configured to eliminate charges on a surface of the recording medium which is electrostatically attracted to the conveyance carrier, and the surface of the conveyance carrier outside an area where the recording medium is attracted, and a reverse voltage applying unit configured to apply a voltage which has a polarity reverse to that of the voltage applied by the voltage applying unit, to the conveyance carrier at a downstream side of the static charge eliminating unit to weaken the electrostatic attraction force of the conveyance carrier.

9 Claims, 8 Drawing Sheets

VOLTAGE CHART OF RECORDING MEDIUM ON CONVEYANCE BELT

CONVEYING APPARATUS AND RECORDING APPARATUS

BACKGROUND OF THE INVENTION

1. Field of the Invention

The present invention relates to a conveying apparatus that attracts a recording medium to a conveyance carrier (e.g., conveyance belt) and conveys the recording medium, and a recording apparatus that performs a recording operation on the recording medium conveyed by the conveying apparatus.

2. Description of the Related Art

Inkjet recording apparatuses that eject ink from a recording head to a recording medium which is conveyed by a conveyance unit are known. Inkjet recording apparatuses can have compact recording heads, record high-definition images with high speed, have cheap running cost, and generate less noise because the apparatus employs a non-impact method. Further, inkjet recording apparatuses can record color images using multi-color ink. Particularly, a full-line type apparatus that employs a line-type recording head in which a large number of discharge ports are arranged in a width direction of the recording medium can perform a recording operation with high speed.

However, when the full-line type apparatus has a great number of line-type recording heads in a conveyance direction of the recording medium, a distance between the recording heat at the most upstream side and the recording head at the most downstream side is long. Therefore, if water content in the recording medium increases in the recording area, the recording medium may be lifted. As a result, the ink discharged from the recording head cannot impact a desired position of the recording medium affecting recording quality. To prevent the influence described above, the recording medium has to be urged toward the conveyance unit so that the recording medium is not lifted.

A method is generally known, which urges the recording medium to the conveyance unit in which an electrode is provided to the conveyance unit, and charges are applied to the electrode to generate electrostatic force to attract the recording medium to the conveyance unit (e.g., Japanese Patent Application Laid-Open No. 2002-284383).

To improve recording quality, a distance between an image recording unit for forming an image on a recording medium and a recording-medium conveyance carrier is set to be 1.0 mm or less in order that a flying speed and flying direction of a main ink droplet which contributes to the recording are not affected by external factors. This configuration aims to improve precision of the ink impact position.

However, when the recording medium is fed to the conveyance carrier, and a voltage applying unit applies voltage to an electrode of an electrode layer of the conveyance carrier to generate electrostatic attraction force, polarization is caused in the recording medium, so that voltage of several hundred volts (V) is induced on a front surface (recording surface) of the recording medium.

When an amount of a discharged main ink droplet is several ten picoliters (pico means parts per trillion), the voltage of several hundred volts (V) dose not give much influence on the ink discharge. However, when the amount of the main ink droplets is decreased to as small as several picoliters to improve the recording quality, the flying speed and the flying direction are apt to be affected by a surface potential of the recording medium, so that a stable recorded image cannot be obtained. Further, small mist-like droplets may be produced in addition to the main ink droplets that contribute to the recording. When the amount of the ink droplets is decreased to several picoliters, the production of mist-like droplets increases. Further, the generated mist is charged due to the voltage induced on the front surface of the recording medium, moves in a direction opposite to the recording direction, and impacts on a surface of a nozzle of the recording head, resulting in defective discharge.

It has been demanded in recent years that not only one surface of a recording medium, but both surfaces thereof, be subject to the recording operation.

When the recording operation is performed on both surfaces of the recording medium, ink is discharged to a first surface by a recording head, and then, ink is discharged to a second surface from the recording head. In this case, when the recording operation is performed on the first surface, a water content in the recording medium increases, so that the recording medium may greatly swell compared to a case where the recording operation is performed on only one surface thereof. Therefore, the recording medium may cause wrinkle (i.e., cockling). This phenomenon may affect the recording quality.

When a two-sided conveyance is employed using the conventional technique described above recording quality may suffer.

If the charged amount (applied voltage) for attracting the recording medium is decreased, the charge amount polarized on the surface of the recording medium is also decreased, so that image disturbance is not caused. However, there is a need to stably transport various types of recording media, including a recording medium that is likely to be curled and a recording medium having high rigidity. Therefore, to surely attract the surface of various types of recording media, to address different smoothness on the recording medium, by means of electrostatic force, the charged amount (applied voltage) has to be increased. In particular, during the two-sided printing operation described above, a surface resistance value of the recording medium is reduced due to the water content in the ink when the first surface is printed. Alternatively, the recording medium is swelled to extremely deteriorate the smoothness, so that a contact area between the conveyance carrier and the recording medium is reduced (the recording medium is difficult to be attracted).

The recording medium is susceptible to the humidity of the environment in which the recording medium is placed. Therefore, depending on the humidity, the surface potential of the recording medium will change making attraction by the recording medium difficult.

SUMMARY OF THE INVENTION

The present invention is directed to a method that can improve recording quality without being affected by a voltage applied for electrostatically attracting a recording medium to a conveyance carrier, and that can surely attract and transport the recording medium by the conveyance carrier, when one-sided and two-sided recording operations are performed.

According to an aspect of the present invention, a conveying apparatus includes a conveyance carrier configured to attract and convey a recording medium, a voltage applying unit configured to apply a voltage to the conveyance carrier to generate electrostatic attraction force on a surface of the conveyance carrier, a static charge eliminating unit configured to eliminate charges on a surface of the recording medium which is electrostatically attracted to the conveyance carrier, and the surface of the conveyance carrier outside an area where the recording medium is attracted, and a reverse voltage applying unit configured to apply a voltage which has a polarity reverse to that of the voltage applied by the voltage applying unit, to the conveyance carrier at a downstream side of the static charge eliminating unit to weaken the electrostatic attraction force of the conveyance carrier.

According to an exemplary embodiment of the present invention, the recording quality can be improved without being affected by the voltage applied for electrostatically attracting the recording medium, and the conveyance carrier can surely attract and transport the recording medium.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

One exemplary embodiment of a recording-medium conveying apparatus to which the present invention is applied will be described in detail with reference to the drawings. A recording-medium conveying apparatus used in an inkjet type recording apparatus that performs a recording operation by discharging ink will be described below as an example.

A recording apparatus provided with a recording-medium conveying apparatus according to the present exemplary embodiment of the present invention will be described in detail with reference to the drawings.

Figure 1:
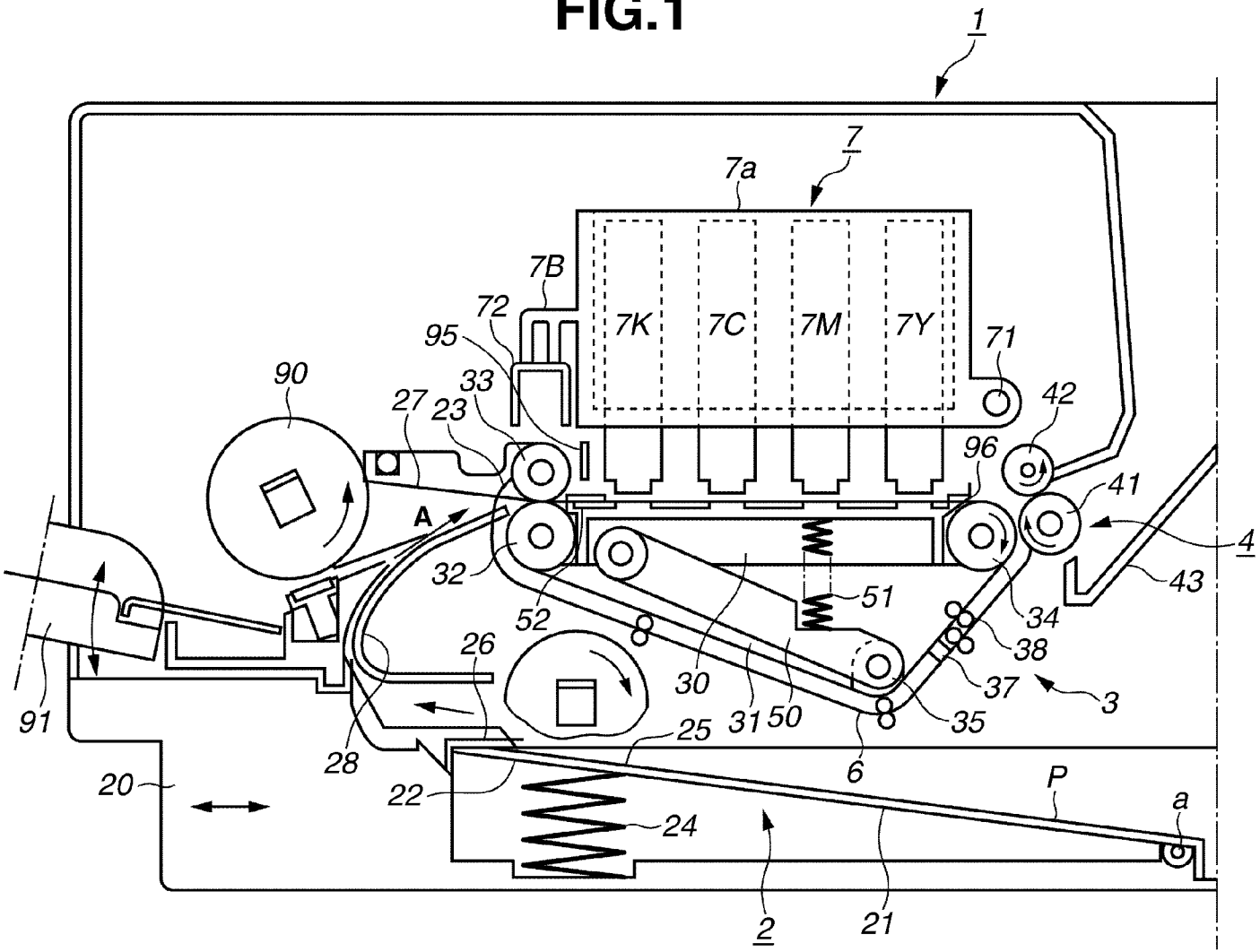
FIG. 1 illustrates an overall configuration of a recording apparatus according to an exemplary embodiment of the present invention.

The overall configuration of the recording apparatus will be described with reference to the drawings. The recording apparatus provided with an automatic sheet feeding apparatus includes a feeding unit, a conveyance belt unit (conveyance unit, conveying apparatus), a two-sided conveyance unit provided to the conveyance belt unit, a discharge unit, and a recording head unit. FIG. 1 is a sectional view illustrating the overall configuration of the recording apparatus 1. With reference to FIG. 1, a feeding unit 2, a conveyance belt unit 3, a two-sided conveyance unit 6, a recording unit 7, and a discharge unit 4 will successively be described.

The feeding unit 2 includes a pressing plate 21 on which a sheet-like recording medium P, such as a sheet, cloth, or film, is stacked, and a sheet-feed rotating member 22 for feeding the recording medium P. Both of the pressing plate 21 and the sheet-feed rotating member 22 are mounted to a base 20. The pressing plate 21 is rotatable around a rotational axis which is coupled to the base 20, and is urged to the sheet-feed rotating member 22 by a pressing plate spring 24. A separating pad 25 made of a material having a great friction coefficient, such as an artificial leather, is provided at a portion of the pressing plate 21 opposite to the sheet-feed rotating member 22 for preventing a double feed of the recording medium P. The base 20 is further provided with a separation claw 26 that covers a corner of the recording medium P in one direction for separating the recording medium P one by one, and a release cam (not illustrated) for releasing the contact between the pressing plate 21 and the sheet-feed rotating member 22.

In the configuration described above, the release cam pushes down the pressing plate 21 to a predetermined position in a stand-by state. Accordingly, the contact between the pressing plate 21 and the sheet-feed rotating member 22 is released. When driving force of a driven pulley 32 is transmitted to the sheet-feed rotating member 22 and the release cam by a gear with this state, the release cam is separated from the pressing plate 21, and the pressing plate 21 lifts up. Then, the sheet-feed rotating member 22 and the recording medium P are brought into contact with each other, and the recording medium P is picked up with the rotation of the sheet-feed rotating member 22, so that the feeding is started. The recording medium P is separated one by one by the separation claw 26, and successively fed to the conveyance belt unit 3. The sheet-feed rotating member 22 rotates until it feeds the recording medium P to the conveyance belt unit 3, and then, the stand-by state is established again in which the contact between the recording medium P and the sheet-feed rotating member 22 is released. When the stand-by state is established, the driving force from the driven pulley 32 is cut.

The feeding unit 2 is also provided with a sheet-feed rotating member for manual feeding. A sheet-feed rotating member 90 rotates according to a recording instruction signal from a computer to convey the recording medium P which is set on a manual feed tray 91 toward the driven pulley 32.

The conveyance belt unit 3 conveys the recording medium P by attracting the recording medium P to a conveyance belt (conveyance carrier) 31. The conveyance belt unit 3 includes the conveyance belt 31 for conveying the recording medium P, and a piezoelectric (PE) sensor (not illustrated).

The conveyance belt 31 includes an attraction force generating unit 36 for attracting the recording medium to the conveyance belt 31.

The conveyance belt 31 is driven by a drive roller 34. The conveyance belt 31 is looped around the drive roller 34, and the driven pulley 32 and a pressure roller 35 that are the driven rollers. The driven pulley 32 and the drive roller 34 are rotatably mounted to a platen 30. The pressure roller 35 is rotatably attached to one end of an arm 50 whose another end is swingably attached to the platen 30. The arm 50 is pressed by a spring 51, so that the pressure roller 35 applies tensile force (2.0 kgf) to the conveyance belt 31. The platen 30 is positioned below the conveyance belt 31 (an opposite side of the recording head across the conveyance belt 31) for regulating downward displacement of the conveyance belt 31.

A pinch roller 33 that moves along with the conveyance belt 31 is provided to a position facing the driven pulley 32 to be in contact with the driven pulley 32. The pinch roller 33 is brought into pressed contact with the conveyance belt 31 by a spring (not illustrated), and guides the recording medium P to the recording head unit.

An upper guide 27 and a lower guide 28 for guiding the recording medium P are provided at an inlet of the conveyance belt unit 3 to which the recording medium P is conveyed. A PE sensor lever 23 that transmits detection of a leading end and trailing end of the recording medium P to the PE sensor (not illustrated) is provided at the upper guide 27.

In the configuration described above, the recording medium P fed to the conveyance belt unit 3 is guided by the upper guide 27 and the lower guide 28 and conveyed to a roller pair configured by the driven pulley 32 and the pinch roller 33. In this case, the PE sensor lever 23 detects the leading end of the conveyed recording medium P to obtain a recording position of the recording medium P. The recording medium P is also conveyed by the rotation of the conveyance belt 31 via the driven pulley 32 by a motor.

The recording unit 7 for forming an image based on image information is provided at a downstream side of the driven pulley 32 in the conveyance direction of the recording medium.

A power supply brush 52 serving as a voltage applying unit for applying a voltage for electrostatically attracting the recording medium to a surface layer of the conveyance belt 31 is arranged in the vicinity of the pinch roller 33 and at a downstream side of the pinch roller 33 in the conveyance direction.

A static charge eliminating member 95 serving as the static charge eliminating unit is arranged at a portion between the vicinity of the power supply brush 52 and the recording unit 7 at a downstream side of the power supply brush 52 in the conveyance direction. The static charge eliminating member 95 eliminates charges on the surface of the recording medium P (the recording surface of the recording medium) which is attracted and held by the conveyance belt 31, and the charges on the surface of the conveyance belt 31 outside the region where the recording medium is attracted, in a non-contact manner. The static charge eliminating member 95 is arranged in a line along the direction orthogonal to the conveyance direction of the conveyance belt 31 with a width greater than a width of the conveyance belt 31.

Further, a power supply brush 96 serving as a reverse voltage applying unit for applying, to the surface of the conveyance belt 31, a voltage reverse to the voltage that generates the electrostatic attraction force, is arranged at a portion between the recording unit 7 and the drive roller 34. By arranging the power supply brush 96, the recording medium on which an image is formed thereon at the recording unit 7 can be easily separated from the conveyance belt 31, and guided to the discharge unit 4.

The conveyance belt 31, that moves as attracting and holding the recording medium P, is made of a synthetic resin, such as polyethylene or polycarbonate, with a thickness of about 0.1 mm to 0.2 mm. The conveyance belt 31 has an endless belt form.

Figure 3:
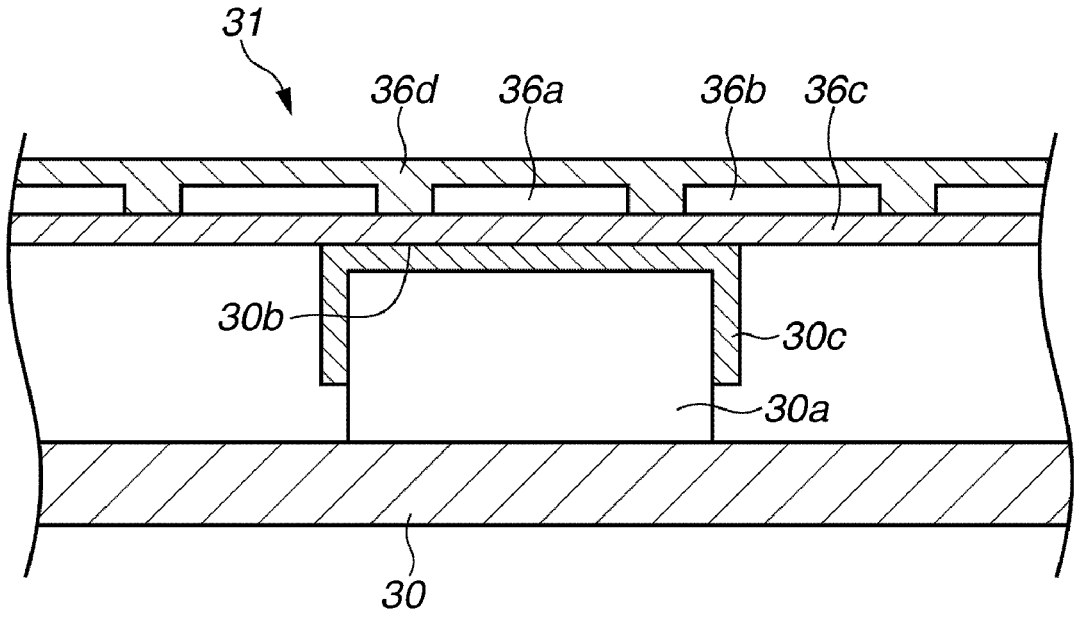
FIG. 3 is a sectional view illustrating a configuration of a platen used in the recording apparatus according to the exemplary embodiment of the present invention.

The conveyance belt 31 includes an attraction force generating unit 36 that is formed by comb-like electrodes which have opposite polarity and include an electrode plate 36*a* and an earth plate 36*b*, a base layer 36*c*, and a surface layer (attraction layer) 36*d* (FIG. 3). The base layer 36*c* and the surface layer 36*d* are bonded by an adhesive or thermal welding method.

Figure 2:
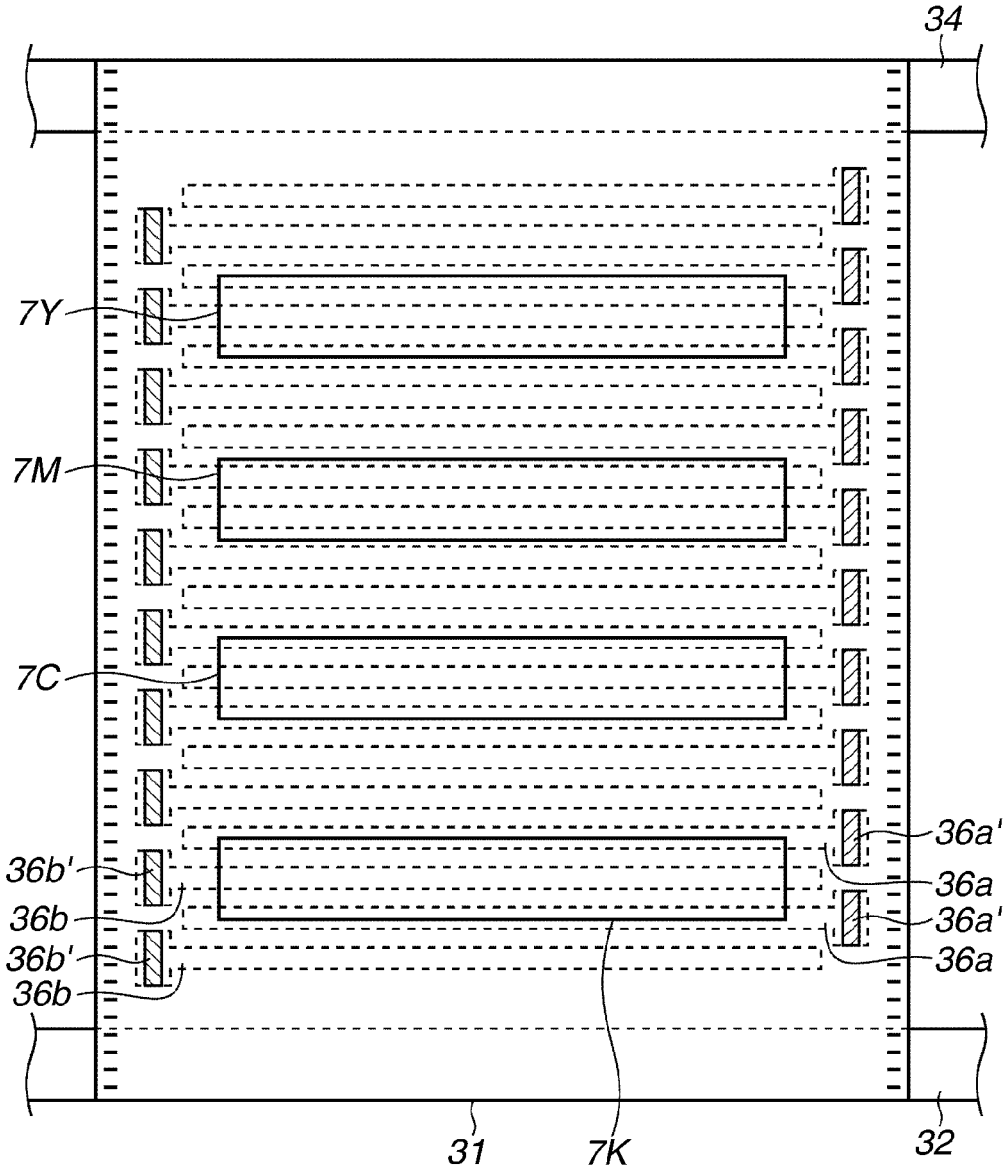
FIG. 2 is a top view illustrating a configuration of a conveyance belt used in the recording apparatus according to the exemplary embodiment of the present invention.

The attraction force generating unit 36 will be described. As illustrated in FIG. 2, the attraction force generating unit 36 is formed such that the electrodes (the electrode plate 36*a* and the earth plate 36*b*) which have the opposite polarity and are made of a conductive metal, are alternately arranged. As illustrated in FIG. 3, each tine of the electrodes 36*a* and 36*b* independently forms a comb-like shape, and a plurality of electrodes is arranged on the conveyance belt 31 to face each other in the direction orthogonal to the belt conveyance direction. Terminals 36*a*' and 36*b*', each of which has a pattern exposed thereto and serves as a power receiving section, are arranged at both side ends of the conveyance belt 31 in the width direction with a distance longer than the width of each of the electrodes 36*a* and 36*b* in a belt moving direction. The conductive power supply brush 52 (FIG. 1) which is brought into contact with the respective electrodes at a predetermined pressure, are provided. A positive or negative voltage is applied to the terminal 36*a*' of the electrode plate 36*a* from a high-voltage power source (not illustrated), while the voltage at the terminal 36*b*' of the earth plate 36*b* is grounded (ground 0 V).

The voltage of about 0.5 kV to 10 kV is applied to the power supply brush 52, so that the attraction force is generated to the conveyance belt 31 at the recording position below each of the recording heads 7. The power supply brush 52 is connected to the high-voltage power source (not illustrated) that generates a predetermined high voltage, and power is supplied during contact time corresponding to the length of the power supply brush 52. When a voltage is applied to the electrode plate 36*a*, electric force is generated in the direction toward the earth plate 36*b* from the electrode plate 36*a*, and an electric line of force is formed. Due to a potential difference between the electrode plate 36*a* and the earth plate 36*b*, the attraction force is generated at an upper position of the conveyance belt 31 and the charges (surface potential) having the same polarity as that of the voltage applied to the electrode plate 36*a* is generated on the recording surface of the recording medium P. The attraction force of the recording medium P becomes the smallest in a region where there is no conductive metal between the electrode plate 36*a* and the earth plate 36*b*.

The power supply brush 96 which applies a voltage reverse to the attraction voltage is arranged at the downstream side of the recording unit 7 in the conveyance direction of the recording medium. The potential remaining, due to an electret phenomenon, on the attraction surface (back surface) of the recording medium P that is brought into contact with the conveyance belt 31 and on the attraction layer 36*d* of the conveyance belt 31 is canceled to be about 0 V by applying the voltage reverse to the voltage applied for generating the attraction force. Thus, the recording medium P can naturally be separated from the conveyance belt 31 to be discharged without adding a physical separating function. The power supply brush 96 is connected to the high-voltage power source (not illustrated) that generates a predetermined high voltage, and power is supplied during contact time corresponding to the length of the power supply brush 96. However, if a range for applying the reverse voltage is too large, the charges may be applied by the reverse voltage even after the charges on the surface layer of the conveyance belt 31 are canceled by the reverse voltage, so that the recording medium P is again attracted to the conveyance belt 31. Accordingly, a length of the power supply brush 96 is desirably substantially equal to the width of the electrode terminals 36*a*' and 36*b*' of the conveyance belt 31.

The conveyance belt unit 3 is also provided with a cleaning roller pair 38. The cleaning roller pair 38 is provided in pressed contact with the conveyance belt 31. The cleaning roller pair 38 can absorb ink to remove stains of ink adhered on the conveyance belt 31, and is made of an open-cell sponge having small pore diameter (preferably, 10 μm to 30 μm) to prevent the deterioration in durability.

After the cleaning roller pair 38 cleans the conveyance belt 31, the charges on the surface layer of the conveyance belt 31 generated due to friction or separation are removed (eliminated) by a static charge eliminating brush 37.

The two-sided conveyance unit 6 turns over the recording medium P which is conveyed by the conveyance belt 31 with the first surface facing upward, and feeds again the recording medium P to the conveyance belt 31 with the second surface which is the back surface of the first surface facing upward.

More specifically, the two-sided conveyance unit 6 turns over the recording medium P as described below. Firstly, the two-sided conveyance unit 6 conveys the recording medium P to which the recording operation is completed on one side (the first surface) to the discharge side. When the trailing end of the recording medium P reaches a nip portion between the discharge roller 41 and a spur 42, the two-sided conveyance unit 6 causes the discharge roller 41 to inversely rotate to convey the recording medium P in the reverse direction. The recording medium P is guided to a two-sided conveyance path arranged below the conveyance belt unit 3 in FIG. 1, conveyed by a plurality of feed rollers in the two-sided conveyance path, and then, fed again on the conveyance belt by passing between the driven pulley 32 and the pinch roller 33. Thus, the surface (second surface) opposite to the surface (first surface) of the recording medium P on which the recording operation is firstly performed can set as a front surface to be directed toward the recording unit 7. Accordingly, the recording operation on both surfaces can be executed.

The recording unit 7 serving as a recording unit employs a line-type inkjet recording head in which a plurality of nozzles are arranged in the direction orthogonal to the conveyance direction of the recording medium P. A recording head 7K (black), a recording head 7C (cyan), a recording head 7M (magenta), and a recording head 7Y (yellow) are arranged in this order with a predetermined intervals therebetween from the upstream side of the conveyance direction of the recording medium P. Each of the recording heads 7K, 7C, 7M, and 7Y is attached to a head holder 7*a*. The recording head can apply heat to ink by a heater. The heat produces film boiling of the ink. Ink droplets are discharged from the nozzle of the recording head by change in the pressure caused by growth or contraction of air bubbles due to the film boiling, and form an image onto the recording medium P.

One end of the recording unit 7 is fixed to be rotatable by a shaft 71. A projection portion 7B formed at the other end thereof is engaged with a rail 72, so that a distance (head-to-paper distance) between the nozzle surface of the recording head and the recording medium P is regulated.

The discharge unit 4 includes the discharge roller 41 and the spur 42. The recording medium P that has been subject to the recording operation at the recording unit 7 is nipped and conveyed by the discharge roller 41 and the spur 42 and discharged onto the discharge tray 43. The discharge roller 41 is driven by a rotational force of the drive roller 34 transmitted via a transmitting unit (not illustrated). Since the spur 42 is a rotating member which rolls on the recording surface after the recording operation, the spur 42 is configured to have a small contact area to the recording medium and not to cause a disturbance on the recorded image on the recording medium, even if the spur 42 is in contact with the recording surface after the recording operation.

As illustrated in FIG. 3, the platen 30 has projection portions 30*a* formed at positions facing the respective recording heads 7K, 7C, 7M, and 7Y. The projection portion 30*a* extends in parallel to the nozzle surface (face surface) of each recording head in the nozzle array direction (the direction orthogonal to the conveyance direction). A surface 30*b* facing the projection portion 30*a* is a plane which has a predetermined width (the width in the belt conveyance direction). Further, the projection portions 30*a* facing the nozzle surface of each recording head are positioned on the same plane.

The projection portion 30*a* is made of a conductive material to obtain sufficient attraction force. A low friction layer 30*c* (thickness: 100 μm, friction coefficient: 0.2), such as Teflon® film or high-molecular-weight polyethylene film, is formed on the overall surface of the surface 30*b* which slides with the conveyance belt 31. Since the friction between the conveyance belt 31 and the platen 30 is reduced, and the rotational load during the rotation of the conveyance belt is stabilized in the manner as described above, conveyance precision on the conveyance belt 31 is secured during the conveyance of the recording medium.

The attraction force generating apparatus 36 having a comb-like shape electrode structure formed by the electrode plate 36*a* and the earth plate 36*b* includes the base layer 36*c* and the attraction layer (surface layer) 36*d*. The both layers are bonded to each other by a bonding method or thermal welding method.

A high insulating material having electric resistivity of 1011 to 1017 Ωcm and dielectric constant of 4.5 or less is used for the attraction layer 36*d* of the conveyance belt 31. However, when the insulating member having high resistivity and low dielectric constant is used for the attraction layer 36*d* of the conveyance belt 31 as described above, an electret phenomenon is induced in which relaxation time of a dielectric-polarized molecule is long. As a result, the recording medium which is attracted and held by the conveyance belt 31 remains attracted and held after the applied voltage is cut. Therefore, it is difficult to separate the recording medium from the conveyance belt 31 after the image is printed.

In the exemplary embodiment of the present invention, even though the high insulating material having electric resistivity of 1011 to 1017 Ωcm and dielectric constant of 4.5 or less is used for the attraction layer 36*d* of the conveyance belt in the structure of the apparatus described above, the recording medium after the recording operation can be smoothly separated from the conveyance belt 31 by employing a method according to the exemplary embodiment of the present invention. The exemplary embodiment of the present invention can also realize a high-quality image formation and stabilized conveyance of the recording medium on the conveyance belt 31 without being affected by the applied voltage for electrostatically attracting the recording medium onto the conveyance belt 31.

Figure 4:
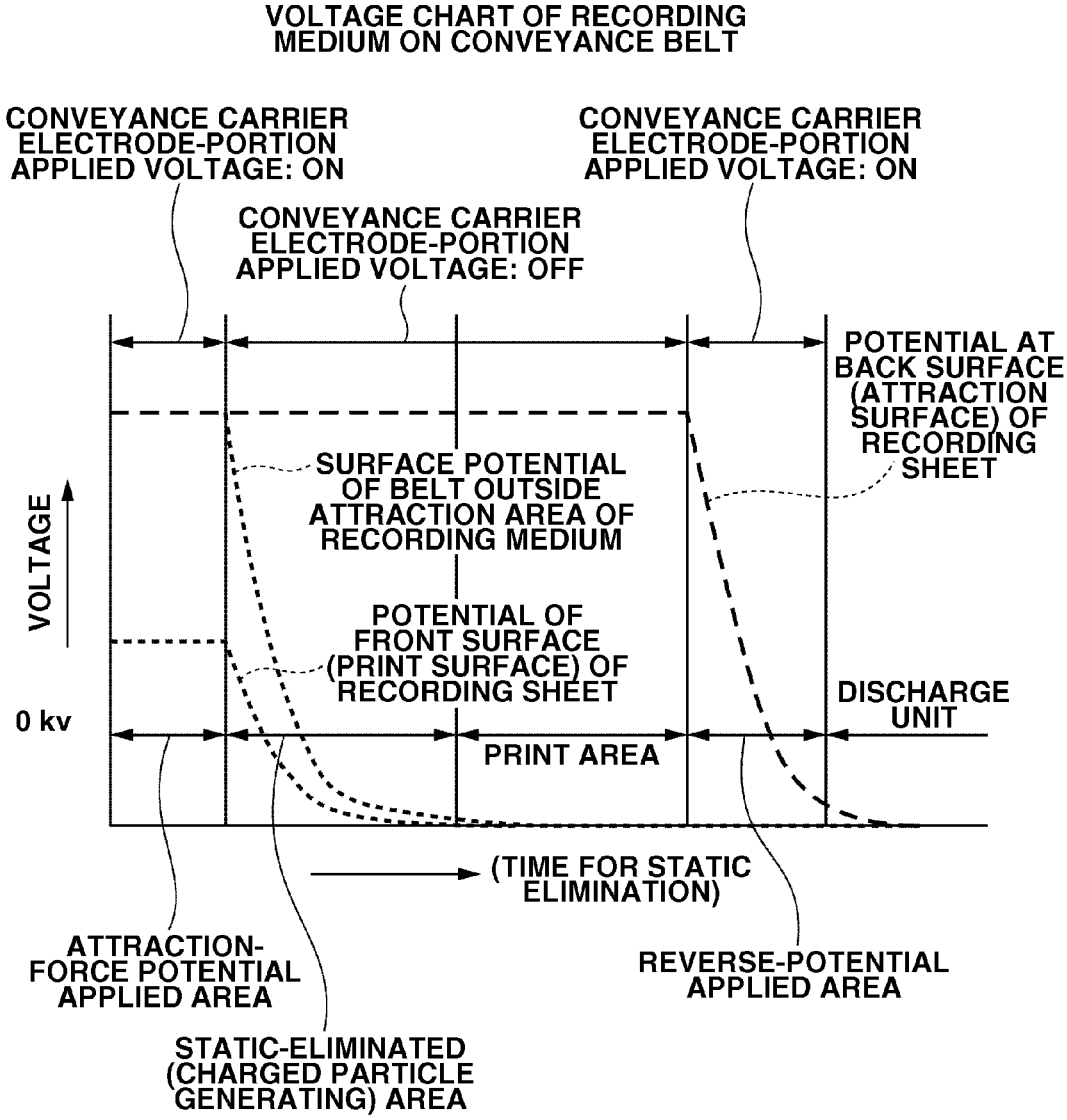
FIG. 4 is a graph illustrating transition of voltage of a recording medium on a conveyance belt according to a first exemplary embodiment.

A voltage condition of a recording medium on a conveyance belt according to a first exemplary embodiment of the present invention will be described in detail with reference to FIG. 4.

It is considered in the present exemplary embodiment of the present invention that the potential amount of the recording medium P on the conveyance belt 31 serving as the conveyance carrier is divided into four blocks as described below.

Block 1. An area in which potential for generating attraction force is applied (an area from the pinch roller 33 serving as the pressure roller to the static charge eliminating member 95 serving as a static charge eliminating device in FIG. 1: voltage applied to the electrode portion of the conveyance carrier: ON area)

In this area, the recording medium is fed to the conveyance carrier. Then, a voltage for generating the electrostatic attraction force is applied to the electrode (36*a* and 36*b*) in the electrode layer of the conveyance carrier by the voltage applying unit (power supply brush 52). As a result, the conveyance carrier and the back surface (attraction surface) of the recording medium are uniformly attracted, and simultaneously, polarization is caused in the recording medium, so that the voltage is induced on the front surface (recording surface) of the recording medium.

Since the actual width of the conveyance carrier is set to be larger than the width of a conveyable recording medium, the potential applied by the voltage applying unit remains on the attraction layer (surface layer) of the conveyance carrier at the area outside the attraction area of the recording medium.

Block 2. A static charge eliminated (charged particle generated) area (an area from the static charge eliminating member 95 to the portion immediately before the recording unit 7: the voltage applied to the electrode portion of the conveyance carrier: OFF area)

In this area, the potential on the surface of the conveyance carrier outside the attraction area of the recording medium and on the surface (the recording surface) of the recording medium is canceled due to attraction of charged particles such as ions. The static charge elimination described above is executed by the non-contact type static charge eliminating member 95 which is arranged in a line with a length substantially equal to the width of the conveyance carrier. In this case, the attraction layer of the conveyance carrier of the recording medium is made of a high insulating material having electric resistivity of 1011 to 1017 Ωcm and dielectric constant of 4.5 or less. In the present exemplary embodiment of the present invention, it has been confirmed through an experiment that the potential required for attracting and conveying the recording medium P remains on the conveyance carrier by utilizing the electret phenomenon in which the relaxation time of the dielectric-polarized molecule is long.

The non-contact type static charge eliminating member 95 is used in the present exemplary embodiment of the present invention. Although a contact-type member such as a static charge eliminating brush is desirable when a cost and a structure of the apparatus is considered, the contact-type member is not employed because of the following reasons. Since the static charge eliminating member slides on the surface of the recording member, paper powder is produced. The paper powder may attach to the nozzle surface of the recording print head and cause the defective discharge. Further, the attraction by the charged particles such as ion is employed in order not to attenuate the potential on the surface of the conveyance carrier outside the attraction area of the recording medium and on the surface (the recording surface) of the recording medium P but to bring the potential thereof to 0 V as short time as possible.

Block 3. A print area (an area immediately below the plurality of recording heads in the recording unit 7: the voltage applied to the electrode portion of the conveyance carrier: OFF area)

In this area, the potential on the surface of the recording medium becomes near 0 V due to the attraction by the charged particles such as ion, according to the experiment in the exemplary embodiment of the present invention. As a result, precision of an ink impact position can be achieved which is not affected by the flying speed and flying direction of ink droplets contributing to the recording and printing. Generation of small mist-like droplets increases in addition to the ink main droplets that contribute to the recording. The configuration in the present exemplary embodiment can prevent the generated mist from being charged by the voltage induced on the surface of the recording medium and moving in the reverse direction of the recording direction. Consequently, the present exemplary embodiment can eliminate a problem in which the mist attached to the nozzle surface of the recording print head causes the defective discharge. Accordingly, a high image quality can satisfactorily be obtained.

The potential required for attracting and conveying the recording medium remains on the attraction layer of the conveyance carrier of the recording medium due to the electret phenomenon. Therefore, the recording medium P can be conveyed in a distance which is set to 1 mm or less between the image recording unit for forming an image on the recording medium and the conveyance carrier of the recording medium to further improve recording quality.

Block 4. A reverse potential applied area (an area from the power supply brush 96 immediately after the recording unit 7 to the drive roller 34: the voltage applied to the electrode portion of the conveyance carrier: ON area)

In this area, the voltage reverse to the voltage for generating the attraction force is applied by the power supply brush 96 to the electrodes (36*a* and 36*b*) of the electrode layer of the conveyance carrier. Thus, the potential remaining on the back surface (attraction surface) of the recording medium is canceled and becomes nearly 0 V. As a result, the recording medium can be naturally separated from the conveyance carrier and discharged without providing a separation function.

IF the recording medium P has high rigidity, it can be separated without applying the reverse voltage. However, the recording medium which has not so high rigidity, such as a plain paper (60 g/m2 to 90 g/m2) cannot be naturally separated, so that the recording medium remains attracted on the conveyance carrier, which causes poor sheet discharge.

Therefore, the voltage having a polarity reverse to that of the voltage applied for attracting the recording medium is applied to the electrodes arranged on the attraction layer of the conveyance carrier during the separation of the recording medium. Accordingly, the functions of the above described exemplary embodiment of the present invention can be realized.

Although the endless belt member is used as the conveyance carrier in the exemplary embodiment described above, the present invention is not limited thereto. For example, a drum-type belt member may be employed.

Although a standard-size sheet (cut sheet) is used in the exemplary embodiment described above, the present invention is not limited thereto. The same effect can be achieved by continuous conveyance of a roll-type sheet.

Further, the inkjet type two-sided recording apparatus for color recording using a plurality of recording heads for different colors is described in the present exemplary embodiment, but the present invention is not limited thereto. For example, the present invention is applicable to an inkjet recording apparatus using one recording head, or an inkjet recording apparatus for gradation recording that uses a plurality of recording heads for a single color ink but different concentration. In other words, the present invention is applicable to any type of inkjet recording apparatus and can provide the same operational effect regardless of a number of recording heads.

As the recording unit (recording head), a cartridge type unit in which a recording head and an ink tank are integrally formed, or a configuration in which a recording head and an ink tank are separately provided and they are connected with an ink supply tube can be employed. Therefore, the present invention is applicable to any apparatuses regardless of structures of the recording unit and ink tank, and the same effect can be achieved.

When the present invention is applied to an inkjet recording apparatus, a recording unit using an electromechanical conversion member such as a piezoelectric element or an electrothermal converter such as a heater can be used. Particularly, the present invention can provide an excellent effect in an inkjet recording apparatus using a recording unit that discharges ink by utilizing thermal energy. According to such configuration, high-density and high-definition recording can be achieved.

The present invention is also effectively applicable to a serial type recording apparatus that performs a recording operation while moving a recording head in the direction orthogonal to the conveyance direction of the recording medium. Alternatively, in the case of a full-line type recording apparatus in which the recording head has a length corresponding to the maximum width of the recording medium, a combination of a plurality of recording heads, or a single integrally-formed recording head may be provided to form the length described above.

Further, the present invention is applicable to an apparatus, in the above described serial-type apparatus, using a recording head fixed to the main body of the apparatus or an apparatus using an exchangeable chip-type recording head that is mounted to the main body of the apparatus to be electrically connected with the main body of the apparatus or to be supplied ink from the main body of the apparatus. Alternatively, the present invention is effective for an apparatus using a cartridge-type recording head having an ink tank integrally formed with a recording head.

An inkjet recording apparatus according to the above described exemplary embodiment may be used as image output terminal apparatuses of an information processing device such as a computer. The above described exemplary embodiment may be used as an inkjet output/input apparatus which can mount a scanner or the like other than the recording head to a carriage, a copying machine combined with a reader, or a facsimile apparatus including a sending/receiving function.

Figure 5:
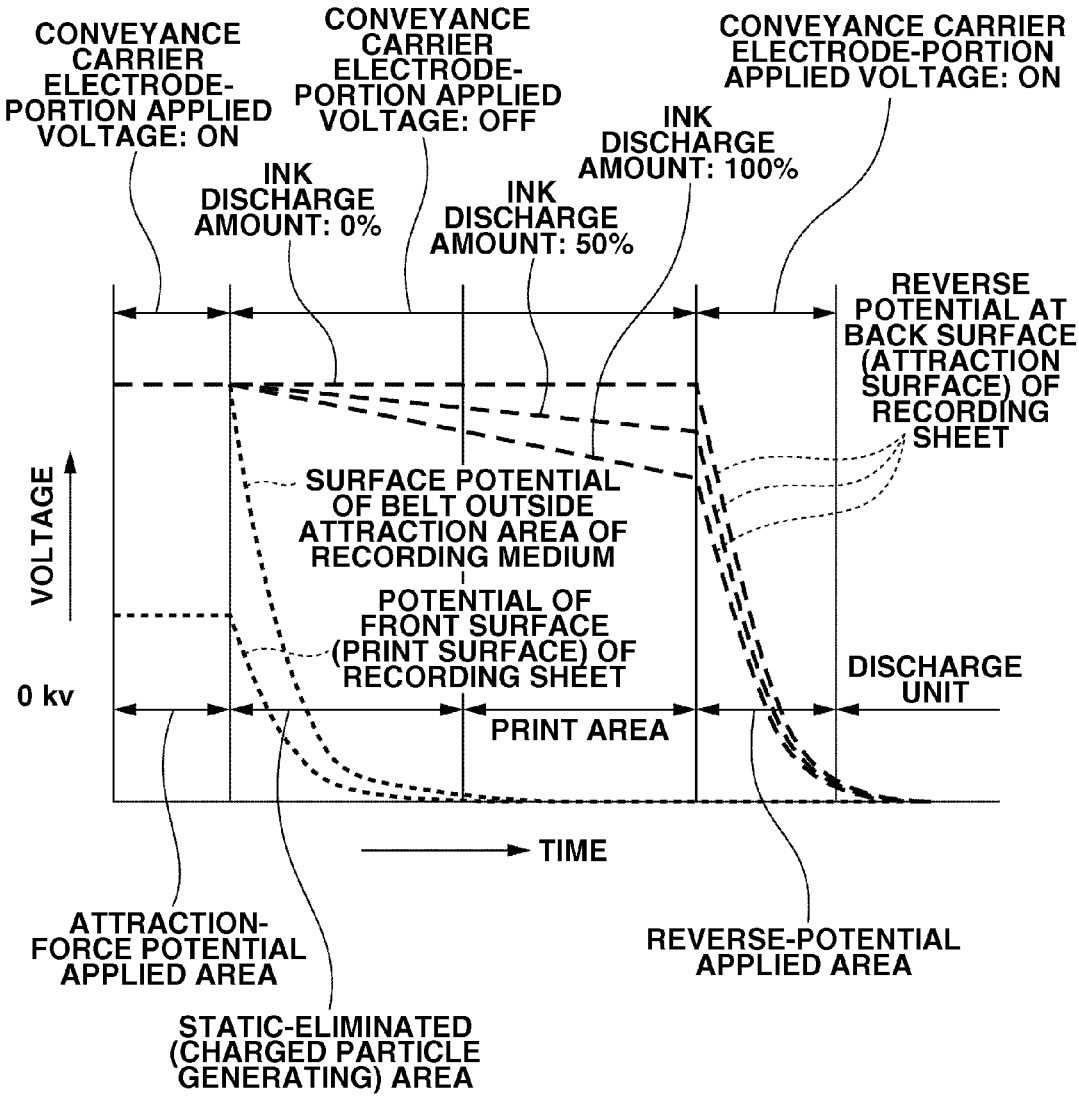
FIG. 5 is a graph illustrating transition of voltage of a recording medium on a conveyance belt according to a second exemplary embodiment.

A second exemplary embodiment of the present invention will be described with reference to FIGS. 5 and 6. The different points from the above described exemplary embodiments will be described here.

It was found in the present invention that when the recording medium P to which the recording operation is performed on both surfaces is attracted to the conveyance belt 31, the reverse-voltage value to be applied has to be changed between a case in which the recording operation is performed on the first surface of the recording medium P and the recording medium P is discharged, and a case in which the recording medium P to which the recording operation on the first surface is completed is conveyed by the two-sided conveyance unit 6 to perform the recording operation on the second surface and the recording medium P is discharge.

When the recording operation is performed on the second surface, the ink droplets have already impacted on the recording medium P, so that the water amount (water content) in the recording medium P is changed. When the water content is increased, the surface resistance value of the recording medium P is reduced.

In the experiment in the exemplary embodiment of the present invention, the following surface resistance values of the recording medium P were obtained:

Case 1. A surface resistance value of the recording medium which includes an average ink discharge amount forming an image of 0%: about 1011 Ωcm Case 2. The surface resistance value of the recording medium which includes the average ink discharge amount forming an image of 25%: about 1010 Ωcm Case 3. The surface resistance value of the recording medium which includes the average ink discharge amount forming an image of 50%: about 109 Ωcm Case 4. The surface resistance value of the recording medium which includes the average ink discharge amount forming an image of 75%: about 108 Ωcm Case 5. The surface resistance value of the recording medium which includes the average ink discharge amount forming an image of 100%: about 107 Ωcm When the recording amount to the recording medium P increases, and the average discharge amount of the ink droplets impacted on the recording medium P increases, the water content in the recording medium P increases in proportion to the increase in the ink discharge amount due to the water in the ink, so that it becomes difficult to attract the recording medium P to the conveyance belt 31.

Figure 6:
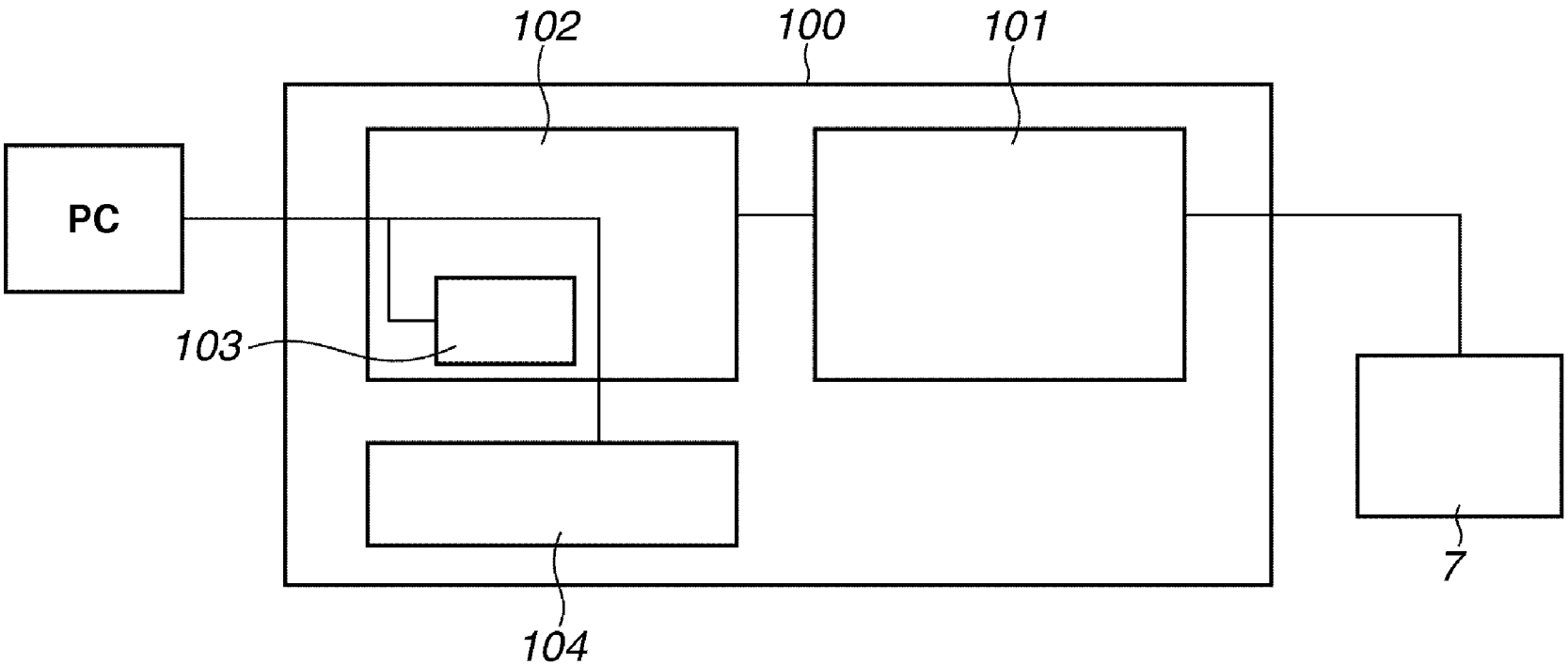
FIG. 6 illustrates a control unit used in the second exemplary embodiment.

Therefore, a dot counting unit 103 for calculating the discharge amount (recording amount) of the ink droplets is arranged in a control unit 100 in the recording apparatus 1 as illustrated in FIG. 6. The reverse voltage which is applied to the conveyance belt 31 for canceling the attraction force of the attraction surface (back surface) of the recording medium P and the conveyance belt 31 is changed based on information obtained from the dot counting unit 103 upon performing the recording operation on the first surface. Then, the recording medium P is discharged after the recording operation on the second surface is completed.

As described above, the surface resistance value of the second surface of the recording medium P decreases due to the ink discharge amount forming the image. The potential remaining on the attraction surface (back surface) of the recording medium P and the attraction layer **36*d* of the conveyance belt 31** due to the electret phenomenon is attenuated in the area in which the voltage applied to the electrode portion of the conveyance carrier is OFF.

When the voltage equal to a potential of the discharge amount of 0% of the ink for forming the image is applied, the reverse charges become higher than the residual charges, so that the voltage applied for attracting the next recording medium P is offset to be lowered. As a result, a problem that the attraction force of the recording medium P to the conveyance belt 31 is reduced may occur. Therefore, the reverse voltage to be applied is changed according to the recording amount transmitted to the head control unit upon performing the recording operation on the first surface.

Consequently, when the recording operation is performed on the second surface, the recording medium P can be stably attracted to the conveyance belt 31 and separated therefrom, like the case of performing the recording operation on the first surface.

The control unit of the two-sided conveying apparatus and the recording apparatus will be described here. As illustrated in FIG. 6, the control unit 100 in the recording apparatus 1 includes an image processing unit 102 for processing image information from a personal computer, and a head control unit 101 that performs a drive control of the recording unit 7 based on the information of the image processing unit 102. The image processing unit 102 also includes the dot counting unit 103 that counts the recording amount (i.e., dots for forming an image) that is recorded on the recording medium and transmitted to the head control unit 101. The image processing unit 102 also includes a page memory (storage unit) 104 that can store information including the recording amount of each of a plurality of the recording media stored in the two-sided conveyance unit 6.

Figure 7:
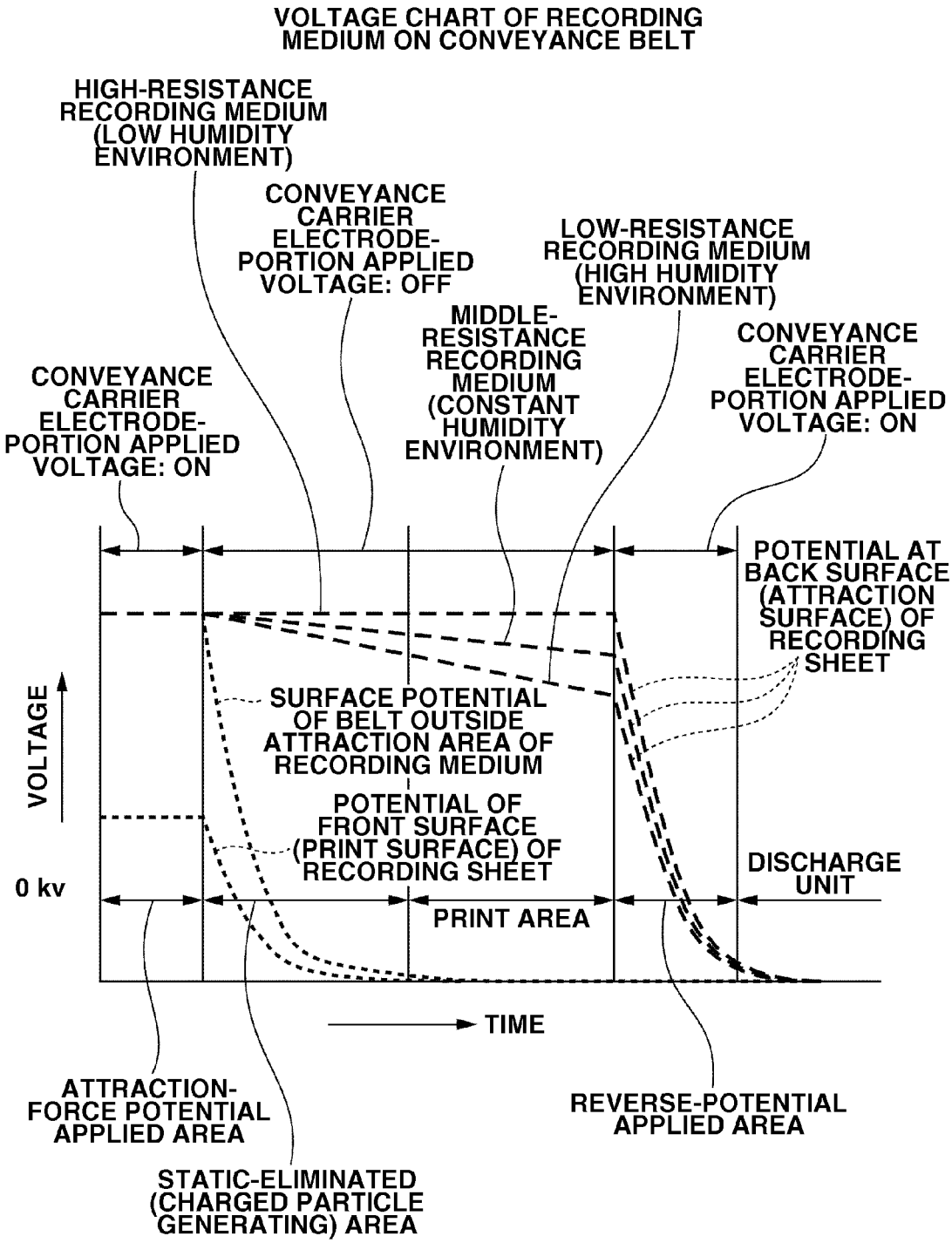
FIG. 7 is a graph illustrating transition of voltage of a recording medium on a conveyance belt according to a third exemplary embodiment.

A third exemplary embodiment of the present invention will be described with reference to FIG. 7. The different points from the above described exemplary embodiments will be described here.

The present exemplary embodiment described below can be added to both or either one of the above described first and second exemplary embodiments.

More specifically, the recording apparatus in the present exemplary embodiment includes a humidity detecting unit (not illustrated) for detecting humidity in the vicinity of the surface of the conveyance carrier of the recording medium mounted at the downstream side of the recording unit 7 in the conveyance direction of the recording medium, in addition to the configuration of both or either one of the above described first and second exemplary embodiments.

When the water content in the recording medium P increases according to the humidity in the atmosphere, the surface resistance value of the recording medium P decreases.

According to the experiment in the exemplary embodiment of the present invention, the water content in the recording medium is 5 to 7% with the humidity of 55 to 65% RH, but in winter, the water content in the recording medium is emitted to the atmosphere with the humidity of 20 to 40% RH. In summer, the water content in the recording medium increases by absorbing the humidity in the atmosphere with the humidity of 80 to 90% RH.

The surface resistance value of the recording medium is as follows according to the experiment.

Case 1. A surface resistance value of the recording medium with 20 to 40% RH: 1014 Ωcm Case 2. The surface resistance value of the recording medium with 55 to 65% RH: 1011 Ωcm Case 3. The surface resistance value of the recording medium with 80 to 90% RH: 108 Ωcm A constant potential is applied to the conveyance carrier of the recording medium at the area where the potential for generating the attraction force is applied illustrated in FIG. 7. On the other hand, the surface resistance value of the recording medium exposed to each environment is changed as described above. Therefore, when a constant voltage is applied to the conveyance carrier in the area where the reverse voltage is applied, the potential cannot completely be canceled, since the recording medium exposed to the environment of 20 to 40% RH has a high surface resistance value, so that the recording medium cannot be separated from the conveyance carrier. Since the recording medium exposed to the environment of 80 to 90% RH has a low surface resistance value, the potential is gradually attenuated, and hence, the reverse potential exceeds the value for canceling the potential. As a result, the charges may be applied on the contrary.

Therefore, in the present exemplary embodiment of the present invention, the detecting unit for detecting the humidity in the vicinity of the conveyance carrier is mounted at the downstream side of the recording unit to cancel the potential on the conveyance carrier of the recording medium by applying the reverse potential which corresponds to the surface potential of the recording medium to the conveyance carrier. Accordingly, the reverse potential corresponding to the detected humidity is applied, and the potential is canceled. Therefore, the recording medium P can be naturally separated from the conveyance carrier and discharged without providing a separation function.

More specifically, the humidity detecting unit (humidity sensor, not illustrated) at the vicinity of the surface of the conveyance carrier detects the humidity in the vicinity of the conveyance carrier. Next, the control unit (not illustrated) provided to the recording apparatus acquires a detection signal, which is obtained by converting the humidity detected by the humidity sensor into a signal, and determines the water content in the recording medium based on the detection signal. Then, the control unit determines the amount of the reverse voltage applied to the conveyance carrier according to the change in the water content.

The control unit determines the applied voltage based on the detected humidity in the present exemplary embodiment. However, the present invention is not limited thereto. For example, the control unit may comprehend the change in the water content in the recording medium by calculating the ink discharge amount from the recording head, and may determine the applied voltage based on the change in the water content. Alternatively, the control unit may acquire both of the data about the detected humidity and the data about the ink discharge amount, and may determine the applied voltage based on both the data.

When the recording operation is performed on both surfaces of the recording medium, it is desirable that the voltage applied in the area where the reverse voltage is applied is determined by adding a degree of influence of the humidity and the ink discharge amount. Accordingly, the functions of the above described exemplary embodiments of the present invention can be realized upon one-sided recording/two-sided recording.

Figure 8:
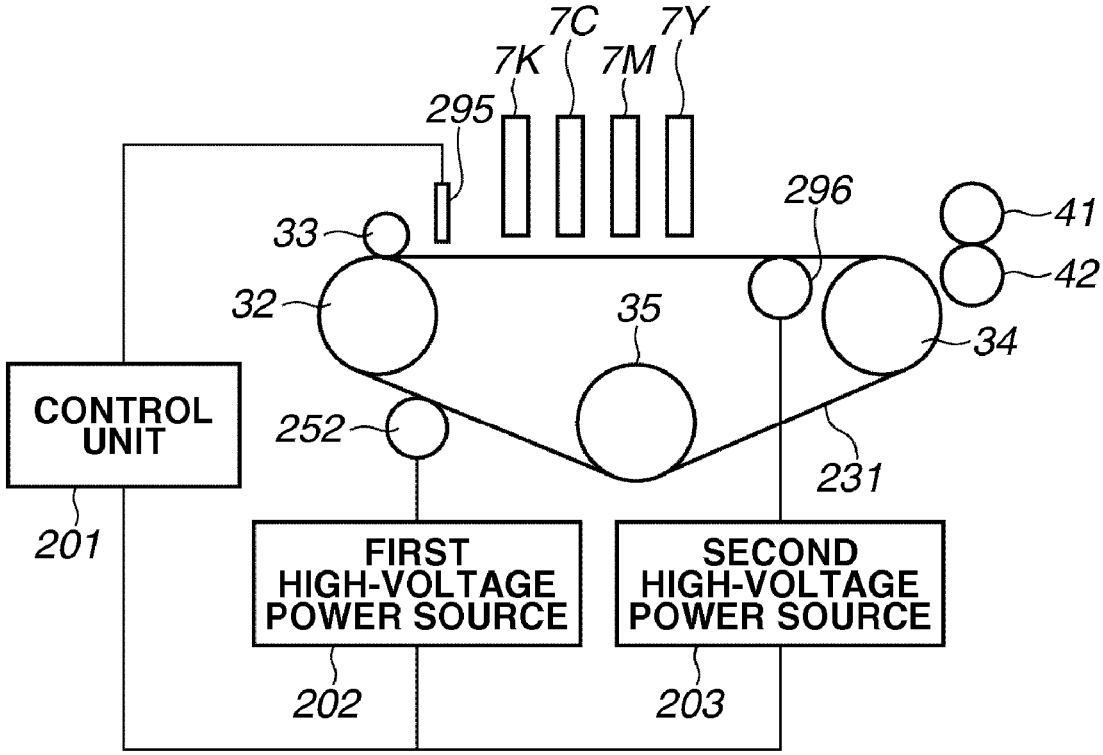
FIG. 8 illustrates a recording apparatus according to a fourth exemplary embodiment.

A recording apparatus according to a fourth exemplary embodiment of the present invention will be described with reference to FIG. 8. The same components as those in the recording apparatus in FIG. 1 are identified by the same numerals, and the description thereof will not be repeated.

A belt 231 does not include an electrode. A surface of the conveyance belt 231 that attracts a recording medium is formed by a high-polymer material having high resistivity and high dielectric constant. A charging roller 252 serves as a voltage applying unit for applying a voltage to the conveyance belt 231 to charge the conveyance belt 231. A high voltage is applied to the charging roller 252 from a first high-voltage power source 202. The conveyance belt to which the high voltage is applied by the charging roller 252 can attract the recording medium to its surface by electrostatic force.

The recording medium fed from a feeding unit is attracted to the conveyance belt 231 between the driven pulley 32 and the pinch roller 33, and conveyed to the recording head group including the recording heads 7K, 7C, 7M, and 7Y. A static charge eliminating member 295 is arranged between the pinch roller 33 and the recording head group. The static charge eliminating member 295 eliminates charges, in a non-contact manner, on the surface (the recording surface of the recording medium) of the recording medium P attracted and held by the conveyance belt 231 and the surface of the conveyance belt 231 outside the area where the recording medium is attracted. The static charge eliminating member 295 is arranged in a line along the direction orthogonal to the conveyance direction of the conveyance belt 231 with a width greater than a width of the conveyance belt 231.

A high-voltage roller 296, serving as a reverse-voltage applying unit for applying a voltage to a surface opposite to the surface of the conveyance belt 231 to which the recording medium is attracted, is arranged at the downstream side of the recording head group. The high-voltage roller 296 applies the voltage having the polarity reverse to that of the charging roller 252 to the conveyance belt 231, so that the charges for attracting the recording medium that remain in the vicinity of the surface of the recording medium on the side of the belt and in the vicinity of the surface of the conveyance belt 231 on the side of the recording medium can be eliminated. A second high-voltage power source 203 supplies a voltage to the high-voltage roller 296.

A control unit 201 controls the first high-voltage power source 202, the second high-voltage power source 203, and the static charge eliminating member 295.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-297966 filed Nov. 21, 2008, which is hereby incorporated by reference herein in its entirety.

What is claimed is:

1. A conveying apparatus comprising:

a conveyance carrier configured to attract and convey a recording medium;

a voltage applying unit configured to apply a voltage to the conveyance carrier to generate electrostatic attraction force on a surface of the conveyance carrier;

a static charge eliminating unit configured to eliminate charges on a surface of the recording medium which are electrostatically attracted to the conveyance carrier and the surface of the conveyance carrier outside an area where the recording medium is attracted;

a reverse voltage applying unit configured to apply a voltage which has a polarity reverse to that of the voltage applied by the voltage applying unit to the conveyance carrier at a downstream side of the static charge eliminating unit to weaken the electrostatic attraction force of the conveyance carrier; and a humidity detecting unit configured to detect humidity in the vicinity of the surface of the conveyance carrier, wherein the reverse voltage applying unit changes the reverse voltage to apply the voltage based on the value detected by the humidity detecting unit.

2. The conveying apparatus according to claim 1, wherein an electrode is embedded into the conveyance carrier, and the voltage applying unit and the reverse voltage applying unit apply a voltage to the electrode.

3. A conveying apparatus comprising:

a conveyance carrier configured to attract and convey a recording medium;

a voltage applying unit configured to apply a voltage to the conveyance carrier to generate electrostatic attraction force on a surface of the conveyance carrier;

a static charge eliminating unit configured to eliminate charges on a surface of the recording medium which are electrostatically attracted to the conveyance carrier and the surface of the conveyance carrier outside an area where the recording medium is attracted;

a reverse voltage applying unit configured to apply a voltage which has a polarity reverse to that of the voltage applied by the voltage applying unit to the conveyance carrier at a downstream side of the static charge eliminating unit to weaken the electrostatic attraction force of the conveyance carrier;

a two-sided conveyance unit configured to turn over the recording medium which is conveyed with a first surface facing upward, feed the recording medium again to the conveyance carrier, and convey the recording medium with a second surface facing upward; and a storage unit configured to store a recording amount recorded on the recording medium, wherein the reverse voltage applying unit changes the reverse voltage and apply the voltage based on the recording amount on the first surface stored in the storage unit.

4. The conveying apparatus according to claim 3, wherein the two-sided conveyance unit can store a plurality of recording media, and the storage unit stores the recording amounts of each of the plurality of the recording media.

5. The conveying apparatus according to claim 1, wherein an attraction layer of the conveyance carrier is made of a high insulating material which has electric resistivity of $10^{11}$ and $10^{17}$ Ωcm and dielectric constant of 4.5 or less, and the attraction layer allows the potential required for attracting and conveying the recording medium to remain on the conveyance carrier by utilizing an electret phenomenon.

6. The conveying apparatus according to claim 1, wherein the conveyance carrier is an endless belt member having no joint.

7. The conveying apparatus according to claim 2, wherein an electrode layer of the conveyance carrier is formed by alternately arranging comb-like shape electrodes which have opposite polarity.

8. A recording apparatus comprising:

a conveying apparatus according to claim 1; and a recording unit arranged downstream of the static charge eliminating unit and configured to record an image on the recording medium that is electrostatically attracted by a conveyance carrier.

9. The recording apparatus according to claim 8, wherein the recording unit comprises an inkjet recording head that discharges ink to the recording medium.

* * * * *